US011564295B2

(12) United States Patent
Zhu et al.

(10) Patent No.: US 11,564,295 B2
(45) Date of Patent: Jan. 24, 2023

(54) FILAMENT DEVICE FOR ILLUMINATION DEVICE, ILLUMINATION DEVICE, AND DIMMING METHOD FOR ILLUMINATION DEVICE

(71) Applicant: SAVANT TECHNOLOGIES LLC, East Cleveland, OH (US)

(72) Inventors: Yimin Zhu, Shanghai (CN); Pan Yao, Shanghai (CN); Jie Gao, Shanghai (CN); Xiangjin Mo, Shanghai (CN); Jiachen Yang, Shanghai (CN); Kun Xiao, Shanghai (CN)

(73) Assignee: SAVANT TECHNOLOGIES LLC, East Cleveland, OH (US)

( * ) Notice: Subject to any disclaimer, the term of this patent is extended or adjusted under 35 U.S.C. 154(b) by 0 days.

(21) Appl. No.: 17/538,349

(22) Filed: Nov. 30, 2021

(65) Prior Publication Data

US 2022/0201818 A1 Jun. 23, 2022

(30) Foreign Application Priority Data

Nov. 30, 2020 (CN) ..... 202011374931.X
Sep. 3, 2021 (CN) ..... 202122123479.6

(51) Int. Cl.
*H05B 45/10* (2020.01)
*H05B 45/31* (2020.01)
(Continued)

(52) U.S. Cl.
CPC ..... *H05B 45/31* (2020.01); *H05B 45/10* (2020.01); *H05B 45/20* (2020.01); *H05B 45/40* (2020.01)

(58) Field of Classification Search
CPC ..... H05B 45/10; H05B 45/19; H05B 45/20; H05B 45/24; H05B 45/28; H05B 45/31;
(Continued)

(56) References Cited

U.S. PATENT DOCUMENTS 8,154,221 B2 * 4/2012 Godbole ..... H05B 45/10 315/307
9,420,644 B1 * 8/2016 Shum ..... F21V 29/763
(Continued)

*Primary Examiner* — Haissa Philogene
(74) *Attorney, Agent, or Firm* — Wood IP LLC

(57) ABSTRACT

Disclosed are a filament device for an illumination device, the illumination device, and a dimming method for the illumination device. The illumination device comprises: a dimming unit electrically connected to an external power supply, a first illumination unit which is electrically connected to the dimming unit and to which an input voltage from the external power supply is applied, a second illumination unit which is electrically connected to the dimming unit and to which an input voltage from the external power supply is applied, a unidirectional conduction unit electrically connected to the first illumination unit and the second illumination unit, a first current-limiting unit electrically connected to the first illumination unit; and a second current-limiting unit electrically connected to the second illumination unit, wherein the amplitude of the input voltage varies on the basis of a phase-cut angle of the dimming unit, when the amplitude of the input voltage varied on the basis of the phase-cut angle satisfies a first predetermined condition, the unidirectional conduction unit is in a turn-on state, and the illumination device operated in a first operation mode; and when the amplitude of the input voltage varied on the basis of the phase-cut angle satisfies a second predetermined condition, the unidirectional conduction unit is in a turn-off state, and the illumination device operates in a second operation mode. The effect of deepening the dimming depth is achieved.

27 Claims, 13 Drawing Sheets

(51) Int. Cl.
*H05B 45/40* (2020.01)
*H05B 45/20* (2020.01)

(58) Field of Classification Search
CPC ..... H05B 45/3577; H05B 45/3725; H05B 45/40; H05B 45/44; H05B 45/46; H05B 45/48
See application file for complete search history.

(56) References Cited

U.S. PATENT DOCUMENTS

| | | | | |
|---|---|---|---|---|
| 11,399,423 | B2 * | 7/2022 | Kotal | H05B 45/46 |
| 2010/0090607 | A1 * | 4/2010 | Vos | H05B 39/08 315/186 |
| 2013/0069561 | A1 * | 3/2013 | Melanson | H05B 45/28 315/297 |
| 2013/0187568 | A1 * | 7/2013 | Jelaca | H05B 47/165 315/307 |
| 2015/0296583 | A1 * | 10/2015 | Xiao | H05B 45/3575 315/307 |
| 2017/0290116 | A1 * | 10/2017 | Bruwer | H05B 45/10 |

* cited by examiner (B)

(A)

FILAMENT DEVICE FOR ILLUMINATION DEVICE, ILLUMINATION DEVICE, AND DIMMING METHOD FOR ILLUMINATION DEVICE

TECHNICAL FIELD

The present utility model relates to an illumination device and method, and more particularly, to a dimmable illumination device and a dimming method for the illumination device.

BACKGROUND

For example, solid state illumination panels have been commonly used as illumination sources in architectural illumination. A solid state illumination panel may include a packaged light-emitting device of one or more light-emitting diodes (LEDs) that emit visible light. The visible light may include light having different wavelengths. The apparent color of visible light can be illustrated with reference to a two-dimensional chromaticity diagram (e.g., a CIE chromaticity diagram and a 1976 CIE u'v' CIE chromaticity diagram). For example, white light emitted by a solid state illumination panel may be a mixture of different wavelengths of light. Some "white" light may appear yellowish in color, while other "white" light may appear bluish in color. In the field of illumination, Planckian locus is used, so that temperature listings along the Planckian locus show the color path of light emitted by a black-body radiator heated to various temperatures. When the heated object becomes incandescent, since the wavelength associated with the peak radiation of the black-body radiator becomes progressively shorter with the increased temperature, it first glows reddish, then yellowish, then white, and finally bluish. Thus, the light-emitting body that emits light on the Planckian locus can be described in terms of correlated color temperature (CCT). White light typically has a CCT of between about 2000K and 10000K, white light with a CCT of 3000K may appear yellowish in color, while white light with a CCT of 8000K may appear bluish in color.

According to practical use requirement, it would be desirable to provide an illumination device capable of adjusting the color temperature of illumination light. FIG. 1 shows a circuit diagram of an illumination device 10 with a color temperature adjustment function in the prior art, and FIG. 2 shows a dimming knob of the illumination device shown in FIG. 1 and a dimming graph. As shown in FIG. 1, a dimming unit (TRIAC) 102 is electrically connected to an external alternating current (AC) power supply, and a phase-cut angle of the dimming unit (TRIAC) 102 is varied according to a user's operation on a dimming knob 202 shown in (A) of FIG. 2. The amplitude of the input voltage from the external alternating current (AC) power supply varies on the basis of the phase-cut angle, then the input voltage having a varied amplitude is applied across the capacitor 104 by means of the rectification circuit (i.e., the rectifier bridge consisting of the diodes D1, D2, D3 and D4) shown in FIG. 1, and thus the voltage across the capacitor 104 is applied to the illumination unit 106, and the LED driving unit 108 drives the illumination unit. Some of the dimming methods used in the prior art are linear, when the voltage applied across the illumination unit is less than the turn-on voltage of the illumination unit (the turn-on voltage of the LED in the illumination unit is high, and in general, the turn-on voltage is 120 Vdc to 140 Vdc), the illumination unit may be turned off during the dimming process. As shown in (B) of FIG. 2, when the dimming knob 202 is rotated to point A, the input voltage at point A is less than the turn-on voltage 204 of the LED, and the dash area in (B) of FIG. 2 causes the dimming stroke of the illumination device to be excessively short. However, with regard to other driving solutions, such as a switch power supply, a dimming stroke thereof is long enough, but deep dimming cannot be achieved, i.e. when a phase-cut angle is low, an LED is still bright and is not dark enough, and thus the problem of insufficient depth cannot be solved.

SUMMARY

The main purpose of the present utility model is to provide an illumination device, so as to solve the problems in the prior art that the dimming stroke of the illumination device is too short and the dimming depth is too shallow.

In order to achieve the described object, according to one aspect of the present utility model, there is provided an illumination device, comprising: a dimming unit electrically connected to an external power supply; a first illumination unit which is electrically connected to the dimming unit and to which an input voltage from the external power supply is applied; a second illumination unit which is electrically connected to the dimming unit and to which an input voltage from the external power supply is applied; a unidirectional conduction unit electrically connected to the first illumination unit and the second illumination unit; a first current-limiting unit electrically connected to the first illumination unit; and a second current-limiting unit electrically connected to the second illumination unit, wherein the amplitude of the input voltage varies on the basis of a phase-cut angle of the dimming unit, when the amplitude of the input voltage varied on the basis of the phase-cut angle satisfies a first predetermined condition, the unidirectional conduction unit is in a turn-on state, and the illumination device operated in a first operation mode; and when the amplitude of the input voltage varied on the basis of the phase-cut angle satisfies a second predetermined condition, the unidirectional conduction unit is in a turn-off state, and the illumination device operates in a second operation mode.

Preferably, the first predetermined condition is that the amplitude of the input voltage varied on the basis of the phase-cut angle is greater than or equal to a sum of a turn-on voltage of the first illumination unit and a turn-on voltage of the second illumination unit.

Preferably, in the first operation mode, the first illumination unit, the unidirectional conduction unit and the second illumination unit are connected in series.

Preferably, the second predetermined condition is that the amplitude of the input voltage varied on the basis of the phase-cut angle is less than the sum of the turn-on voltage of the first illumination unit and the turn-on voltage of the second illumination unit.

Preferably, in the second operation mode, the first illumination unit and the first current-limiting unit form a first series circuit, the second illumination unit and the second current-limiting unit form a second series circuit, and the first series circuit and the second series circuit are connected in parallel.

Preferably, when the amplitude of the input voltage varied on the basis of the phase-cut angle satisfies a third predetermined condition, the unidirectional conduction unit is in a turn-off state, and the illumination device operates in a third operation mode.

Preferably, the third predetermined condition is that the amplitude of the input voltage varied on the basis of the phase-cut angle is greater than the turn-on voltage of the first illumination unit and less than the turn-on voltage of the second illumination unit.

Preferably, in the third operation mode, the first illumination unit is in a turn-on state and the second illumination unit is in a turn-off state.

Preferably, when the color temperature of the first illumination unit and the second illumination unit are the same, the brightness of the illumination device operated in the first operating mode is higher than the brightness of the illumination device operated in the second operating mode, and the brightness of the illumination device operated in the second operating mode is higher than the brightness of the illumination device operated in the third operating mode.

Preferably, in cases where the color temperature of the first illumination unit is the same as the color temperature of the second illumination unit, the brightness of the illumination device operated in the first operation mode is higher than the brightness of the illumination device operated in the second operation mode; and in cases where the color temperature of the first illumination unit is different from the color temperature of the second illumination unit, the color temperature of the illumination device operated in the first operation mode is higher than the color temperature of the illumination device operated in the second operation mode, and/or the brightness of the illumination device operated in the first operation mode is higher than the brightness of the illumination device operated in the second operation mode.

Preferably, in cases where the color temperature of the first illumination unit is the same as the color temperature of the second illumination unit, the brightness of the illumination device operated in the first operation mode is higher than the brightness of the illumination device operated in the second operation mode, the brightness of the illumination device operated in the second operation mode is higher than the brightness of the illumination device operated in the third operation mode; and in cases where the color temperature of the first illumination unit is different from the color temperature of the second illumination unit, the color temperature and/or brightness of the illumination device operated in the first operation mode is higher than the color temperature and/or brightness of the illumination device operated in the second operation mode, the color temperature and/or the brightness of the illumination device operated in the second operation mode is higher than the color temperature and/or the brightness of the illumination device operated in the third operation mode.

Preferably, a positive terminal of the unidirectional conduction unit is connected to a common terminal of the first illumination unit and the first current-limiting unit, and a negative terminal of the unidirectional conduction unit is connected to a common terminal of the second illumination unit and the second current-limiting unit.

Preferably, the illumination device further comprises an illumination unit driver electrically connected to the dimming unit, the first illumination unit, and the second illumination unit.

Preferably, each of the first illumination unit and the second illumination unit comprises one or more light-emitting devices (LED) connected in series or in parallel.

Preferably, each of the first current-limiting unit and the second current-limiting unit comprises a resistor.

Preferably, the unidirectional conduction unit comprises at least one of a transistor, a thyristor and a relay.

Preferably, the transistor comprises a light emitting diode.

In order to achieve the above purpose, according to one aspect of the present utility model, a filament device for an illumination device is provided, including: a substrate; a first illumination unit, arranged on the substrate, herein an input voltage from an external power source is applied to the first illumination unit through a dimming unit of the illumination device; a second illumination unit, arranged on the substrate, herein the input voltage from the external power source is applied to the second illumination unit through the dimming unit of the illumination device; a unidirectional conduction unit, herein the unidirectional conduction unit is electrically connected with the first illumination unit and the second illumination unit; a first current-limiting unit, electrically connected with the first illumination unit; and a second current-limiting unit, electrically connected with the second illumination unit, herein the amplitude of the input voltage varies on the basis of a phase-cut angle of the dimming unit, while the amplitude of the input voltage varied on the basis of the phase-cut angle satisfies a first predetermined condition, the unidirectional conduction unit is in a turn-on state, and the filament device operates in a first operation mode; and while the amplitude of the input voltage varied on the basis of the phase-cut angle satisfies a second predetermined condition, the unidirectional conduction unit is in a turn-off state, and the filament device operates in a second operation mode.

Preferably, the first predetermined condition is that: the amplitude of the input voltage varied on the basis of the phase-cut angle is greater than or equal to a sum of a turn-on voltage of the first illumination unit and a turn-on voltage of the second illumination unit.

Preferably, in the first operation mode, the first illumination unit, the unidirectional conduction unit and the second illumination unit are connected in series.

Preferably, the second predetermined condition is that: the amplitude of the input voltage varied on the basis of the phase-cut angle is less than the sum of the turn-on voltage of the first illumination unit and the turn-on voltage of the second illumination unit.

Preferably, in the second operation mode, the first illumination unit and the first current-limiting unit form a first series circuit, the second illumination unit and the second current-limiting unit form a second series circuit, and the first series circuit and the second series circuit are connected in parallel.

Preferably, while the amplitude of the input voltage varied on the basis of the phase-cut angle satisfies a third predetermined condition, the unidirectional conduction unit is in the turn-off state, and the illumination device operates in a third operation mode.

Preferably, the third predetermined condition is that: the amplitude of the input voltage varied on the basis of the phase-cut angle is greater than the turn-on voltage of the first illumination unit, and the amplitude of the input voltage varied on the basis of the phase-cut angle is less than the turn-on voltage of the second illumination unit.

Preferably, in the third operation mode, the first illumination unit is in the turn-on state, and the second illumination unit is in the turn-off state.

Preferably, in the case that the color temperature of the first illumination unit is the same as the color temperature of the second illumination unit, the brightness of the filament device operated in the first operation mode is higher than the brightness of the filament device operated in the second operation mode; and in the case that the color temperature of the first illumination unit is different from the color temperature of the second illumination unit, the color temperature of the filament device operated in the first operation mode is higher than the color temperature of the filament device operated in the second operation mode, and/or the brightness of the filament device operated in the first operation mode is higher than the brightness of the filament device operated in the second operation mode.

Preferably, in the case that the color temperature of the first illumination unit is the same as the color temperature of the second illumination unit, the brightness of the filament device operated in the first operation mode is higher than the brightness of the filament device operated in the second operation mode, and the brightness of the filament device operated in the second operation mode is higher than the brightness of the filament device operated in the third operation mode; and in the case that the color temperature of the first illumination unit is different from the color temperature of the second illumination unit, the color temperature and/or brightness of the filament device operated in the first operation mode is higher than the color temperature and/or brightness of the filament device operated in the second operation mode, the color temperature and/or the brightness of the filament device operated in the second operation mode is higher than the color temperature and/or the brightness of the filament device operated in the third operation mode.

Preferably, a positive terminal of the unidirectional conduction unit is connected to a common terminal of the first illumination unit and the first current-limiting unit, and a negative terminal of the unidirectional conduction unit is connected to a common terminal of the second illumination unit and the second current-limiting unit.

In order to achieve the above purpose, according to one aspect of the present utility model, an illumination device is provided, including: a dimming unit, electrically connected with an external power source; and the filament device including any one of the above.

Preferably, the illumination device further includes an illumination unit driver electrically connected with the dimming unit and the filament device.

By means of the technical solution of the present utility model, an illumination device is provided. By switching a circuit connection manner in the illumination device according to a change in an amplitude value of an input voltage, the problems in the prior art that a dimming stroke of the illumination device is too short and a dimming depth is too shallow are solved.

BRIEF DESCRIPTION OF THE DRAWINGS

The drawings illustrated herein, constituting a part of the present application, are used for providing further understanding of the present disclosure, and the illustrative embodiment and illustrations thereof are used for explaining the present disclosure, rather than constitute inappropriate limitation on the present disclosure. In the drawings.

The figures include the following reference signs:

10, 30, 60, 90, 120: illumination device;
102, 302, 602, 902, 1202: dimming unit;
104, 304, 604, 904, 1204: capacitor;
106: illumination unit;
202: dimming knob;
204: turn-on voltage of the LED;
108, 308, 608, 908, 1208: LED driving unit;
306-1, 606-1, 906-1, 1206-1: First illumination unit;
306-2, 606-2, 906-2, 1206-2: Second illumination unit;
310-1, 610-1, 910-1, 1210-1: First current-limiting unit;
310-2, 610-2, 910-2, 1210-2: Second current-limiting unit; and
312, 612, 912, 1212: Unidirectional conduction unit.

DETAILED DESCRIPTION OF THE EMBODIMENTS

It should be noted that, without conflict, the embodiments and the features of embodiments of the present disclosure can be combined. The present utility model will be described in details below with reference to the accompanying drawings and embodiments.

It is noted that, unless otherwise indicated, all technical and scientific terms used herein have the same meaning as those commonly understood by one of ordinary skill in the art to which this application belongs.

In the present utility model, unless otherwise specified, the orientation words such as "upper, lower, top, and bottom" are generally described relative to the directions shown in the Figures, or described relative to the components themselves in a vertical, vertical, or gravitational direction; likewise, for ease of understanding and description, the words "inner, outer" refer to the inside and outside relative to the outline of each component itself, but the described orientation is not used to limit the present utility model.

In order to solve the problems in the prior art that the dimming stroke of the illumination device is too short and the dimming depth is shallow, an illumination device and a dimming method for the illumination device are provided.

Figure 1:
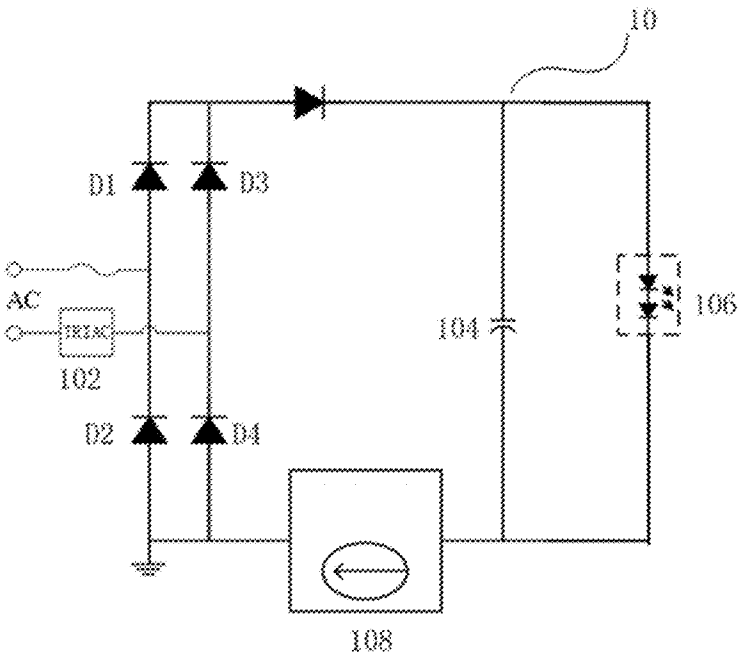
FIG. 1 shows a circuit diagram of an illumination device with a color temperature adjustment function in the prior art.
Figure 2:
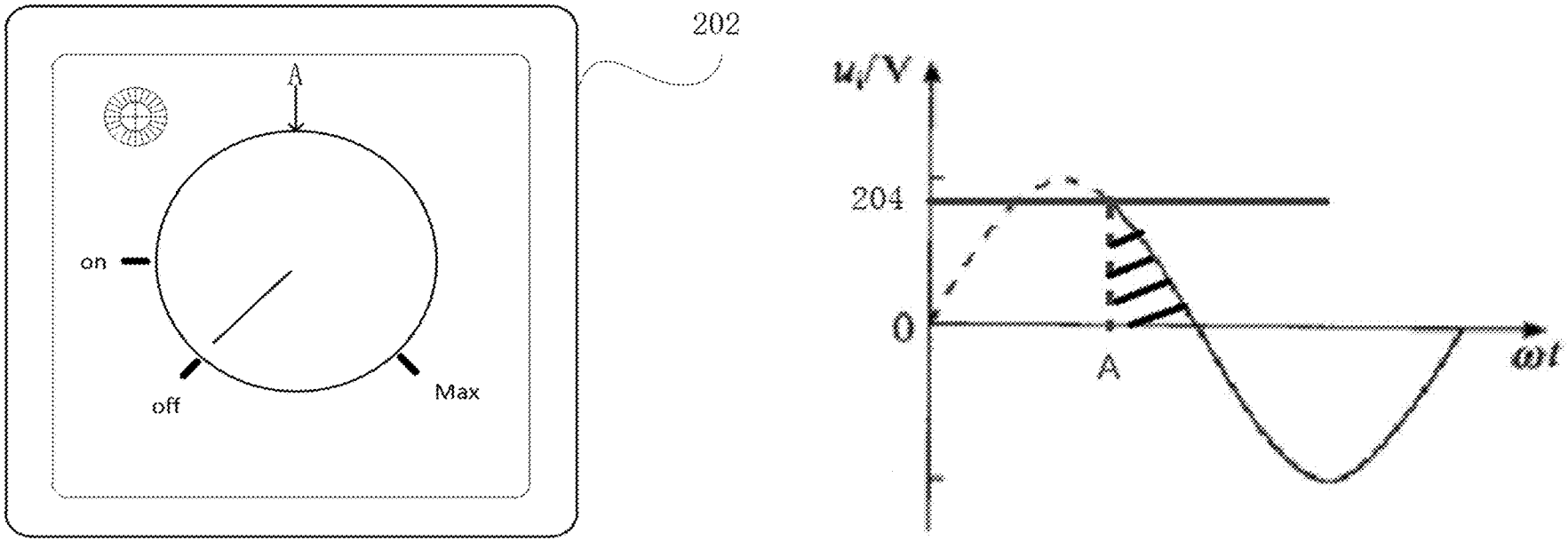
FIG. 2 shows a dimming knob of the illumination device shown in FIG. 1 and a dimming graph.
Figure 3:
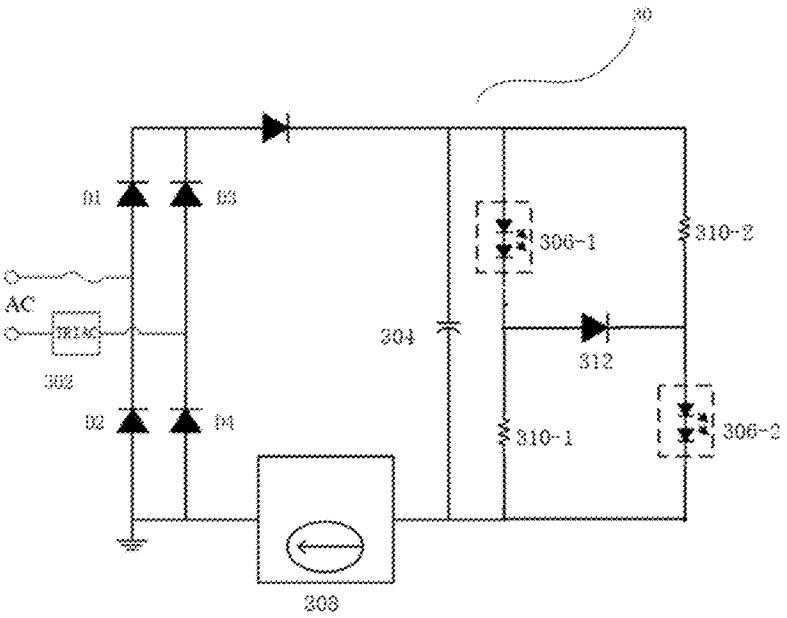
FIG. 3 shows a circuit diagram of an illumination device according to an embodiment of the present utility model.

FIG. 3 shows a circuit diagram of an illumination device according to an embodiment of the present utility model. As shown in FIG. 3, the illumination device 30 comprises: a dimming unit 302, which is electrically connected to an external AC power supply; a rectifier bridge formed by diodes D1, D2, D3, and D4; a capacitor 304; a first illumination unit 306-1 which is connected to the first current-limiting unit 310-1 in series and is electrically connected to the LED drive unit 308; a second illumination unit 306-2 which is connected to the second current-limiting unit 310-2 in series and is electrically connected to the LED drive unit 308; a unidirectional conduction unit 312 electrically connected to the first illumination unit 306-1 and the second illumination unit 306-2, wherein a positive terminal of the unidirectional conduction unit 312 is connected to a common terminal of the first illumination unit 306-1 and the first current-limiting unit 310-1, a negative terminal of the unidirectional conduction unit 312 is connected to a common terminal of the second illumination unit 306-2 and the second current-limiting unit 310-2, and the unidirectional conduction unit 312, the first illumination unit 306-1, and the second illumination unit 306-2 have the same conduction direction. The manner in which the illumination device 30 operates will be described below in details with reference to FIGS. 4 and 5.

Figure 4:
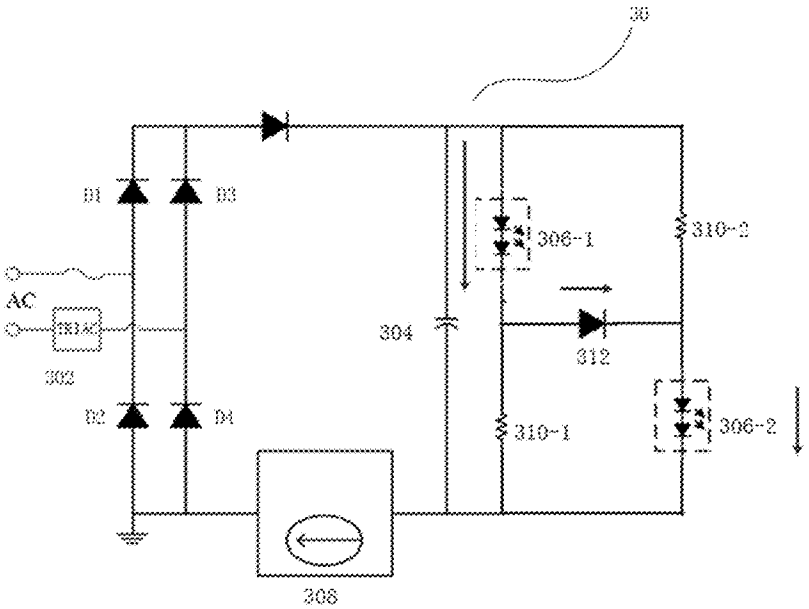
FIG. 4 shows a circuit diagram of an illumination device according to an embodiment of the present utility model operated in a first operation mode.
Figure 5:
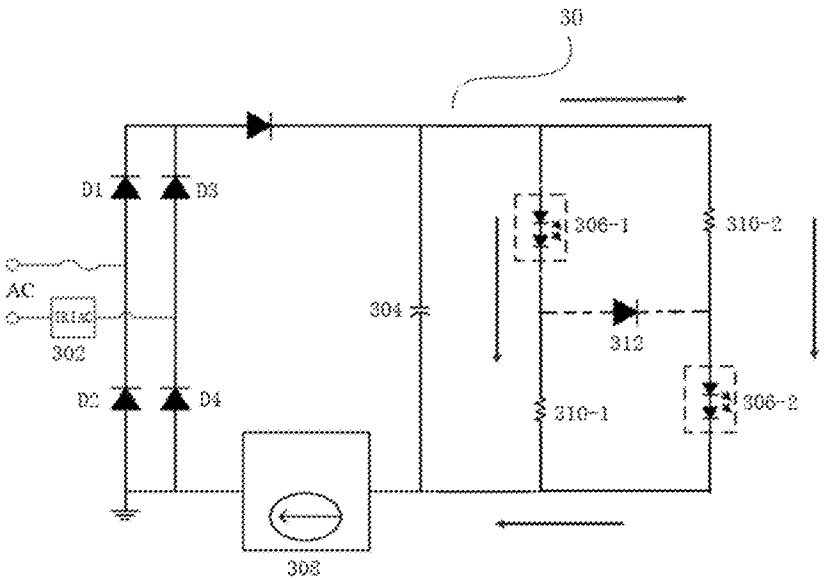
FIG. 5 shows a circuit diagram of an illumination device operated in a second operation mode according to an embodiment of the present utility model.

In an illumination device with deepened dimming depth, the color temperature of the first illumination unit 306-1 is the same as the color temperature of the second illumination unit 306-2. For example, according to the user's operation on the dimming controller, the phase-cut angle of the dimming unit 302 is varied, and the amplitude of the input voltage from the external AC power supply varies as the phase-cut angle varies, and then via the rectifier bridge, the input voltage, of which the amplitude varies on the basis of the phase-cut angle, is applied across the capacitor 304, and the voltage across the capacitor 304 is applied to the first illumination unit 306-1 and the second illumination unit 306-2. As shown in FIG. 4, when the amplitude of the input voltage varied on the basis of the phase-cut angle is greater than or equal to a sum of a turn-on voltage of the first illumination unit 306-1 and a turn-on voltage of the second illumination unit 306-2, i.e., when the amplitude of the input voltage is large, the unidirectional conduction unit 312 is turned on, the first illumination unit 306-1, the unidirectional conduction unit 312, and the second illumination unit 306-2 are connected in series, the direction of the current is indicated by an arrow in FIG. 4, in this case, the current flowing through the first current-limiting unit 310-1 and the second current-limiting unit 310-2 is small, and the illumination device 30 operates in a first operating mode. Further, as shown in FIG. 5, when the amplitude of the input voltage varied on the basis of the phase-cut angle is less than a sum of a turn-on voltage of the first illumination unit 306-1 and a turn-on voltage of the second illumination unit 306-2, i.e., when the amplitude of the input voltage is small, the unidirectional conduction unit 312 is in a turn-off state, the first illumination unit 306-1 and the first current-limiting unit 310-1 form a first series circuit, the second illumination unit 306-2 and the second current-limiting unit 310-2 form a second series circuit, the first series circuit and the second series circuit are connected in parallel, the direction of the current is as indicated by the arrows in FIG. 5, and the illumination device 30 operates in a second operation mode. In addition, when the amplitude of the input voltage varied on the basis of the phase-cut angle further decreases, so that the amplitude of the input voltage is greater than the turn-on voltage of the first illumination unit 306-1, but less than the turn-on voltage of second illumination unit 306-2 (wherein the turn-on voltage of the first illumination unit 306-1 is less than the turn-on voltage of the second illumination unit 306-2), the first illumination unit 306-1 is in a turn-on state, the second illumination unit 306-2 is in a turn-off state, and the illumination device 30 operates in a third operating mode. Therefore, in the illumination device provided by the present utility model, the connection manner of the first illumination unit 306-1 and the second illumination unit 306-2 may be automatically switched according to the amplitude of the input voltage, that is, during dimming, when the amplitude of the input voltage is decreased to a predetermined threshold, the connection manner between the first illumination unit 306-1 and the second illumination unit 306-2 is automatically switched to be parallel connection, the turn-on voltage of the whole illumination unit can be reduced, in other words, the illumination device can be turned on and emit light even at a low input voltage, and accordingly, the dimming stroke can be made longer, and deeper dimming depth can be realized.

In the illumination device with deepened dimming depth, the color temperature of the first illumination unit 306-1 is the same as the color temperature of the second illumination unit 306-2, the brightness of the illumination device 30 operated in the first operation mode is higher than the brightness of the illumination device 30 operated in the second operation mode, and the brightness of the illumination device 30 operated in the second operation mode is higher than the brightness of the illumination device 30 operated in the third operation mode.

The resistance values of the first current-limiting unit 310-1 and the second current-limiting unit 310-2 can be selected according to practical requirements, i. e. the greater the resistance value, the deeper the realized dimming depth. Specifically, according to this embodiment, the turn-on voltage of the first illumination unit 306-1 is less than the turn-on voltage of the second illumination unit 306-2, and thus the first illumination unit 306-1 turns off later than the second illumination unit 306-2. When only the first illumination unit 306-1 is turned on, and the second illumination unit 306-2 is turned off, the larger the resistance value of the first current-limiting unit 310-1, the smaller the current flowing through the first illumination unit 306-1, and the darker the brightness thereof, the deeper the dimming depth achieved by the illumination device. According to practical requirements, each of the first illumination unit 306-1 and the second illumination unit 306-2 includes one or more light-emitting devices (LED) connected in series or in parallel. Each of the first current-limiting unit 310-0 and the second current-limiting unit 310-2 includes a resistor, e.g. a variable resistor. A transistor (e. g., a light emitting diode), a thyristor, a relay, or the like may be used as the unidirectional conduction unit 312.

Figure 6:
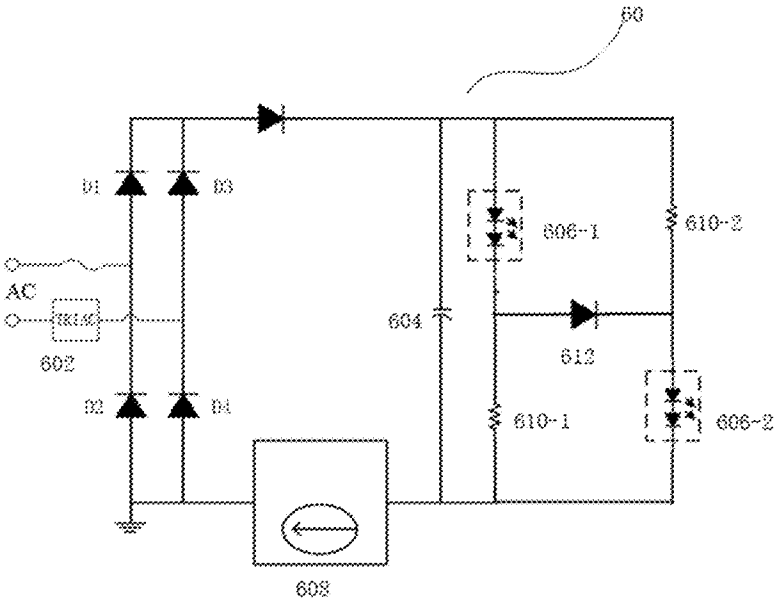
FIG. 6 shows a circuit diagram of an illumination device according to another embodiment of the present utility model.

FIG. 6 shows a circuit diagram of an illumination device according to another embodiment of the present utility model. The circuit configuration shown in FIG. 6 mainly differs from FIG. 3 in that the color temperature of the first illumination unit 606-1 is different from the color temperature of the second illumination unit 606-2. The operation of the illumination device 60 will be described below in details with reference to FIG. 6.

In an illumination device capable of warm dimming, the color temperature of the first illumination unit 606-1 is different from the color temperature of the second illumination unit 606-2. Assuming that the color temperature of the first illumination unit 606-1 is less than the color temperature of the second illumination unit 606-2, and the turn-on voltage of the first illumination unit 606-1 is less than the turn-on voltage of the second illumination unit 606-2, then the resistance value of the first current-limiting unit 610-1 is less than or equal to the resistance value of the second current-limiting unit 610-2. For example, according to the user's operation on the dimming controller, the phase-cut angle of the dimming unit 602 is varied, and the amplitude of the input voltage from the external AC power supply varies as the phase-cut angle varies, and then via the rectifier bridge, the input voltage, of which the amplitude varies on the basis of the phase-cut angle, is applied across the capacitor 604, and the voltage across the capacitor 604 is applied to the first illumination unit 606-1 and the second illumination unit 606-2. When the amplitude of the input voltage varied on the basis of the phase-cut angle is greater than or equal to a sum of a turn-on voltage of the first illumination unit 606-1 and a turn-on voltage of the second illumination unit 606-2, i.e., when the amplitude of the input voltage is large, the unidirectional conduction unit 612 is turned on, the first illumination unit 606-1, the unidirectional conduction unit 612, and the second illumination unit 606-2 are connected in series, in this case, the current flowing through the first current-limiting unit 610-1 and the second current-limiting unit 610-2 is small, and the illumination device 60 operates in a first operating mode. In this case, the color temperature of the illumination device 60 is an average of the color temperature of the first illumination unit 606-1 and the color temperature of the second illumination unit 606-2. During dimming process, when the amplitude of the input voltage varied on the basis of the phase-cut angle is less than a sum of a turn-on voltage of the first illumination unit 606-1 and a turn-on voltage of the second illumination unit 606-2 and when the amplitude of the input voltage varied on the basis of the phase-cut angle is greater than a turn-on voltage of the second illumination unit 606-2, i.e., when the amplitude of the input voltage is small, the unidirectional conduction unit 612 is in a turn-off state, the first illumination unit 606-1 and the first current-limiting unit 610-1 form a first series circuit, the second illumination unit 606-2 and the second current-limiting unit 610-2 form a second series circuit, the first series circuit and the second series circuit are connected in parallel, and the illumination device 60 operates in a second operation mode. In this case, the color temperature of the illumination device 60 is an average of the color temperature of the first illumination unit 606-1 and the color temperature of the second illumination unit 606-2. Next, if the amplitude of the input voltage varied on the basis of the phase-cut angle is further decreased below the turn-on voltage of the second illumination unit 606-2, the first series circuit formed by the first illumination unit 606-1 and the first current-limiting unit 610-1 is in a turn-on state, the second series circuit formed by the second illumination unit 606-2 and the second current-limiting unit 610-2 is in a disconnected state, and the illumination device 60 operates in the third operation mode. In this case, only the first illumination unit 606-1 illuminates, while the second illumination unit 606-2 is turned off, and the color temperature of the illumination device 60 is equal to the color temperature of the first illumination unit 606-1. Therefore, in the illumination device provided by the present utility model, the connection mode of the first illumination unit 606-1 and the second illumination unit 606-2 having different color temperatures is automatically switched according to the amplitude of the input voltage, so that not only can the dimming stroke be extended, but also the dimming depth is deepened, and the warm dimming can also be achieved.

In the illumination device capable of warm dimming, the color temperature of the first illumination unit 606-1 is different from the color temperature of the second illumination unit 606-2, the color temperature and/or brightness of the illumination device 60 operated in the first operation mode is higher than the color temperature and/or brightness of the illumination device 60 operated in the second operation mode, and the color temperature and/or brightness of the illumination device 60 operated in the second operation mode is higher than the color temperature and/or brightness of the illumination device 60 operated in the third operation mode.

Figure 7:
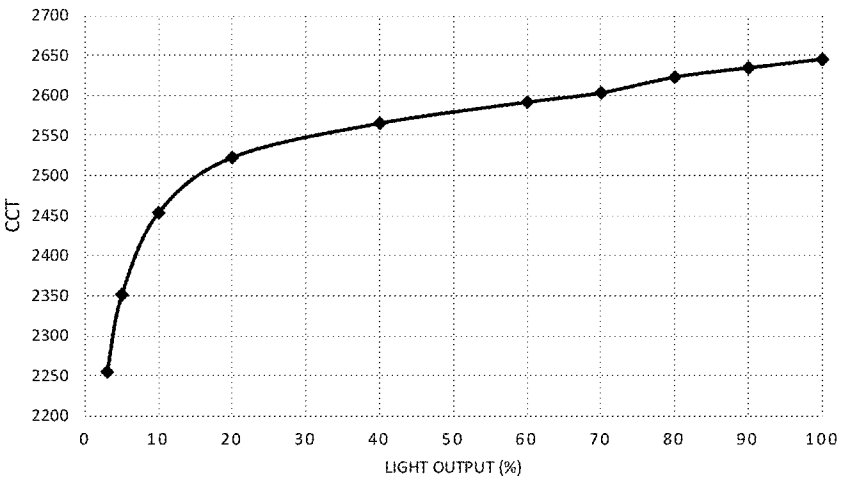
FIG. 7 shows a graph of the relationship of light output and color temperature of the illumination device shown in FIG. 6.

FIG. 7 shows a graph of the relationship of light output and color temperature of the illumination device shown in FIG. 6. In the illumination device according to the utility model, an LED module with a color temperature of 2300 K and an LED module with a color temperature of 3000 K are used as the first illumination unit and the second illumination unit, respectively, in order to achieve a color temperature change from 2300 K to 2700 K in the dimming process. In addition, by varying the color temperature of the LED module, the warm dimming effect can be further improved.

Figure 8:
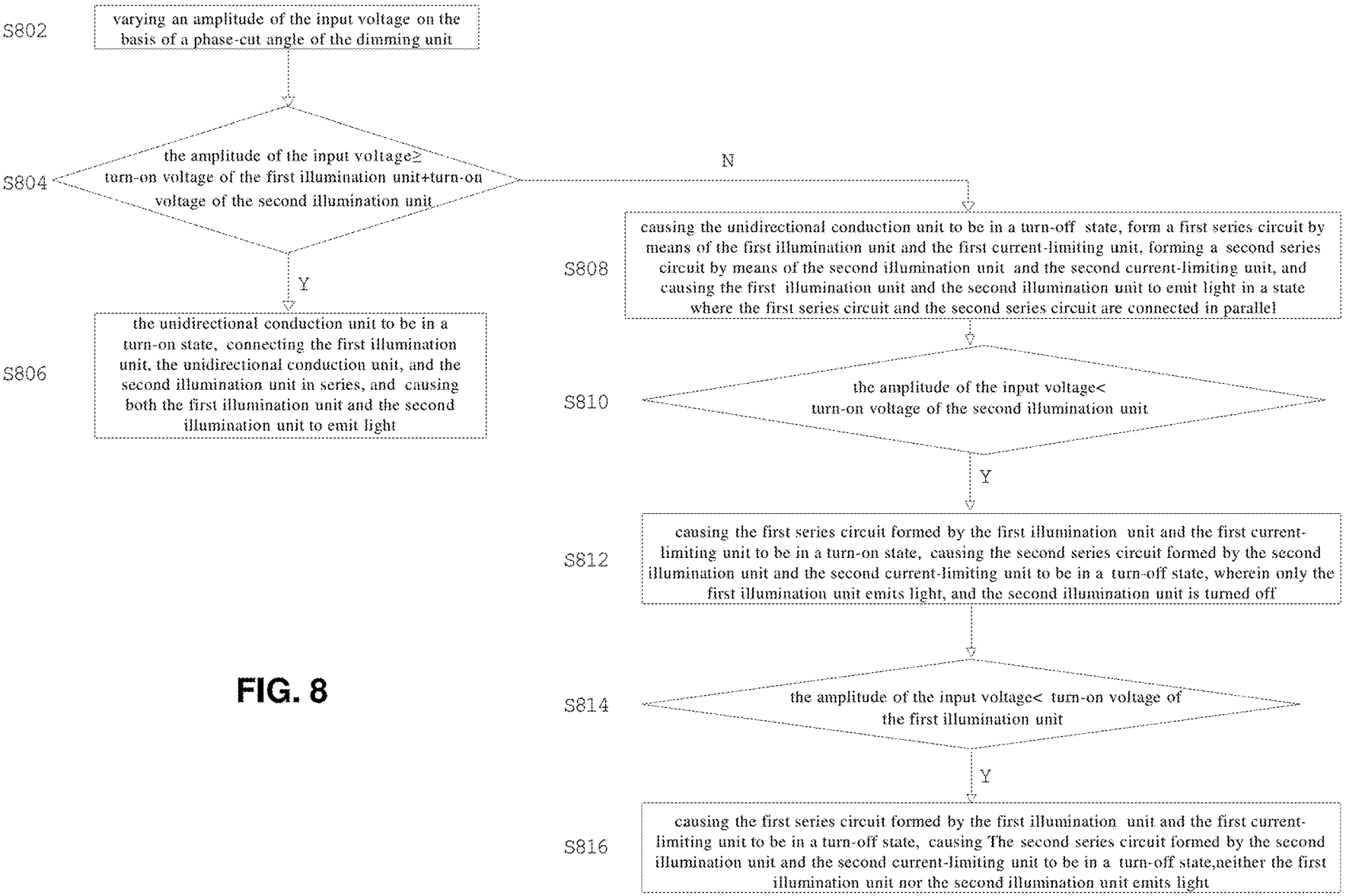
FIG. 8 shows a dimming method for an illumination device according to an embodiment of the present utility model.

FIG. 8 shows a dimming method for an illumination device according to an embodiment of the present utility model. The dimming method shown in FIG. 8 may be applied to the illumination device 30 shown in FIG. 3 or the illumination device 60 shown in FIG. 6. The dimming method comprises: S802, varying an amplitude of the input voltage on the basis of a phase-cut angle of the dimming unit; S804, determining whether the amplitude of the input voltage is greater than or equal to the sum of a turn-on voltage of the first illumination unit and a turn-on voltage of the second illumination unit; S806, if the determination result in S804 is "yes", causing the unidirectional conduction unit to be in a turn-on state, connecting the first illumination unit, the unidirectional conduction unit, and the second illumination unit in series, and causing both the first illumination unit and the second illumination unit to emit light; S808, if the determination result in S804 is "no", causing the unidirectional conduction unit to be in a turn-off state, form a first series circuit by means of the first illumination unit and the first current-limiting unit, forming a second series circuit by means of the second illumination unit and the second current-limiting unit, and causing the first illumination unit and the second illumination unit to emit light in a state where the first series circuit and the second series circuit are connected in parallel; S810, determining whether the amplitude of the input voltage continues to decrease to be lower than the turn-on voltage of the second illumination unit (in this embodiment, the turn-on voltage of the second illumination unit is greater than the turn-on voltage of the first illumination unit); S812, if the determination results in S810 is "yes", i.e. if the amplitude of the input voltage continues to decrease to be lower than the turn-on voltage of the second illumination unit, causing the first series circuit formed by the first illumination unit and the first current-limiting unit to be in a turn-on state, causing the second series circuit formed by the second illumination unit and the second current-limiting unit to be in a turn-off state, wherein only the first illumination unit emits light, and the second illumination unit is turned off; S814, determining whether the amplitude of the input voltage continues to decrease to be below the turn-on voltage of the first illumination unit; S816, if the determination result in S814 is "yes", i.e. when the amplitude of the input voltage continues to decrease to be below the turn-on voltage of the first illumination unit, causing the first series circuit formed by the first illumination unit and the first current-limiting unit to be in a turn-off state, causing the second series circuit formed by the second illumination unit and the second current-limiting unit to be in a turn-off state, wherein neither the first illumination unit nor the second illumination unit emits light.

For the illumination device shown in FIG. 1 to FIG. 6, it may be easily installed in the scenarios of a plastic bulb. In the case of a glass filament bulb, due to the increase in the number of guide wires, for example, four guide wires are required to pass through a stem, it may cause the following problems: the stem is easy to crack, and an inert gas for heat dissipation in the bulb of the illumination device may be leaked from a crack of the stem, therefore the safety and life of the illumination device may be degraded. In addition, as the color temperature is increased, the number of lead-out electrodes and support wires of a filament is also increased, so that the number of spot welding is increased, the labor and manufacturing costs are increased due to the complexity of a production process and the increased assembly difficulty, and it is not suitable for an E12 lamp holder.

In view of the above situations, the present utility model further provides a structure for achieving dimming in the filament. In recent years, an LED filament lamp may present a 360-degree light emitting angle and excellent illumination brightness, and it may be assembled in a bulb lamp or a candle lamp to obtain a light emitting effect similar to an incandescent lamp, and attracts more and more attention. Since the existing LED filament packaging achieves the white light emitting by adopting a principle that a blue chip excites yellow phosphor to emit light compositely, a yellow phosphor layer is coated on an LED chip during the filament packaging, and the appearance color of an LED filament is yellow. The LED filament includes: a filament substrate layer and an LED chip layer 2. The filament substrate layer is provided with an electrode lead terminal, the LED chip layer is fixed on an upper surface of the filament substrate layer, and the LED chip achieves the electrical connection between the chip and the chip and the electrical connection between the chip and the electrode lead terminal through a metal wire or line. The filament substrate layer is an FPC flexible circuit substrate. In addition, the filament substrate layer may also be selected as a ceramic substrate, a glass substrate, a sapphire substrate or a metal substrate. The LED chip layer is a blue chip, on which phosphor is coated. In the case that the phosphor is excited, light emitted by the LED chip is converted into the white light, and the same color temperature or different color temperatures may be achieved.

Figure 9:
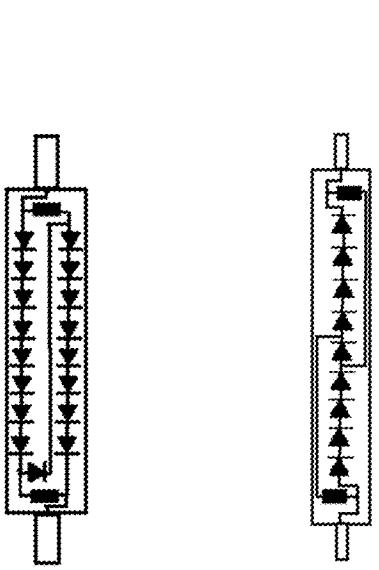
FIG. 9 shows a circuit diagram of an illumination device according to another embodiment of the present utility model.

FIG. 9 shows a circuit diagram of an illumination device according to another embodiment of the present utility model. As shown in (A) of FIG. 9, the illumination device 90 includes: a dimming unit 902, electrically connected with an external power source AC; a rectifier bridge composed of diodes D1, D2, D3, and D4; a capacitor 904; a first illumination unit 906-1, connected in series with the first current-limiting unit 910-1, and electrically connected with an LED driving unit 908; a second illumination unit 906-2, connected in series with the second current-limiting unit 910-2, and electrically connected with the LED driving unit 908; a unidirectional conduction unit 912, electrically connected with the first illumination unit 906-1 and the second illumination unit 906-2, herein a positive terminal of the unidirectional conduction unit 912 is connected to a common terminal of the first illumination unit 906-1 and the first current-limiting unit 910-1, and a negative terminal of the unidirectional conduction unit 912 is connected to a common terminal of the second illumination unit 906-2 and the second current-limiting unit 910-2, the conduction directions of the unidirectional conduction unit 912, the first illumination unit 906-1 and the second illumination unit 906-2 are the same. As shown in (B) of FIG. 9, the first illumination unit 906-1, the second illumination unit 906-2, the first current-limiting unit 910-1, the second current-limiting unit 910-2, and the unidirectional conduction units 912 in the illumination device 90 are all contained in the filament. For example, the filament includes a substrate, and the first illumination unit 906-1, the second illumination unit 906-2, the first current-limiting unit 910-1, the second current-limiting unit 910-2, and the unidirectional conduction unit 912 are arranged on the substrate. According to actual needs, the arrangement modes of the first illumination unit 906-1, the second illumination unit 906-2, the first current-limiting unit 910-1, the second current-limiting unit 910-2, and the unidirectional conduction unit 912 may be arbitrarily selected. For example, the first illumination unit 906-1 and the second illumination unit 906-2 may be arranged side by side on the substrate, or the first illumination unit 906-1 and the second illumination unit 906-2 may be arranged in a row on the substrate. As mentioned above, the first illumination unit 906-1 and the second illumination unit 906-2 may be blue light chips on which phosphor is coated. In the case that the phosphor is excited, light emitted by the first illumination unit 906-1 and the second illumination unit 906-1 is converted into white light, and the same color temperature or different color temperatures may be achieved.

The operation mode of the illumination device 90 is described in detail below with reference to FIG. 10 and FIG. 11.

In the illumination device with deep dimming, the color temperatures of the first illumination unit 906-1 and the second illumination unit 906-2 in the filament are the same as each other. For example, according to the operation of a user on a dimming controller, a phase-cut angle of the dimming unit 902 is varied, and the amplitude of the input voltage from the external power source AC is varied with the change of the phase-cut angle, and then through the rectifier bridge, the input voltage of which the amplitude is varied on the basis of the phase-cut angle is applied to two ends of the capacitor 904, and the voltage of the two ends of the capacitor 904 is applied to the first illumination unit 906-1 and the second illumination unit 906-2. As shown in FIG. 10, while the amplitude of the input voltage varied on the basis of the phase-cut angle is greater than or equal to a sum of a turn-on voltage of the first illumination unit 906-1 and a turn-on voltage of the second illumination unit 906-2, namely, in the case that the amplitude of the input voltage is larger, the unidirectional conduction unit 912 is turned on, and the first illumination unit 906-1, the unidirectional conduction unit 912, and the second illumination unit 906-2 are connected in series, and the current direction is as shown by an arrow in FIG. 10. At this time, the current flowing through the first current-limiting unit 910-1 and the second current-limiting unit 910-2 is relatively small, and the illumination device 90 operates in the first operation mode. In addition, as shown in FIG. 11, while the amplitude of the input voltage varied on the basis of the phase-cut angle is smaller than the sum of the turn-on voltage of the first illumination unit 906-1 and the turn-on voltage of the second illumination unit 906-2, namely, in the case that the amplitude of the input voltage is relatively small, the unidirectional conduction unit 912 is in the turn-off state, the first illumination unit 906-1 and the first current-limiting unit 910-1 form a first series circuit, and the second illumination unit 906- 2 and the second current-limiting unit 910-2 form a second series circuit, the first series circuit and the second series circuit are connected in parallel, the current direction is as shown by an arrow in FIG. 11, and the illumination device 90 operates in the second operation mode. In addition, the turn-on voltage of the first illumination unit 906-1 and the turn-on voltage of the second illumination unit 906-2 may be the same or different from each other. In the case that the turn-on voltage of the first illumination unit 906-1 and the turn-on voltage of the second illumination unit 906-2 are different from each other (for example, the turn-on voltage of the first illumination unit 906-1 is smaller than the turn-on voltage of the second illumination unit 906-2), while the amplitude of the input voltage varied on the basis of the phase-cut angle is further reduced, so that the amplitude of the input voltage is greater than the turn-on voltage of the first illumination unit 906-1, but less than the turn-on voltage of the second illumination unit 906-2, the first illumination unit 906-1 is in the turn-on state, the second illumination unit 906-2 is in the turn-off state, and the illumination device 90 operates in the third operation mode. Therefore, in the illumination device provided by the present utility model, the connection mode of the first illumination unit 906-1 and the second illumination unit 906-2 may be automatically switched according to the amplitude of the input voltage, namely, in the process of dimming, while the amplitude of the input voltage is reduced to a predetermined threshold, the connection mode of the first illumination unit 906-1 and the second illumination unit 906-2 is automatically switched to a parallel mode, the overall turn-on voltage of the illumination unit may be reduced, namely the illumination device may maintain turn-on and light emission under a lower input voltage, so that the dimming stroke may be prolonged and deeper dimming may be achieved.

In the illumination device with the deep dimming, the color temperatures of the first illumination unit 906-1 and the second illumination unit 906-2 are the same as each other, and the brightness of the illumination device 90 operated in the first operation mode is higher than the brightness of the illumination device 90 operated in the second operation mode, and the brightness of the illumination device 90 operated in the second operation mode is higher than the brightness of the illumination device 90 operated in the third operation mode.

According to actual needs, the resistance values of the first current-limiting unit 910-1 and the second current-limiting unit 910-2 may be selected, namely, the resistance value is greater, and the deeper dimming is achieved. Specifically, according to this embodiment, the turn-on voltage of the first illumination unit 906-1 is less than the turn-on voltage of the second illumination unit 906-2, so the first illumination unit 906-1 is turned off after the second illumination unit 906-2 is turned off. While only the first illumination unit 906-1 is turned on and the second illumination unit 906-2 is turned off, the resistance value of the first current-limiting unit 910-1 is greater, the current flowing through the first illumination unit 906-1 is smaller, and the brightness thereof is darker, therefore the dimming achieved by this illumination device is deeper. According to actual needs, each of the first illumination unit 906-1 and the second illumination unit 906-2 includes one or more LEDs connected in series or in parallel. Each of the first current-limiting unit 910-1 and the second current-limiting unit 910-2 includes a resistor, for example, a variable resistor. A transistor (for example, an LED) may be used as the unidirectional conduction unit 912.

Figure 12:
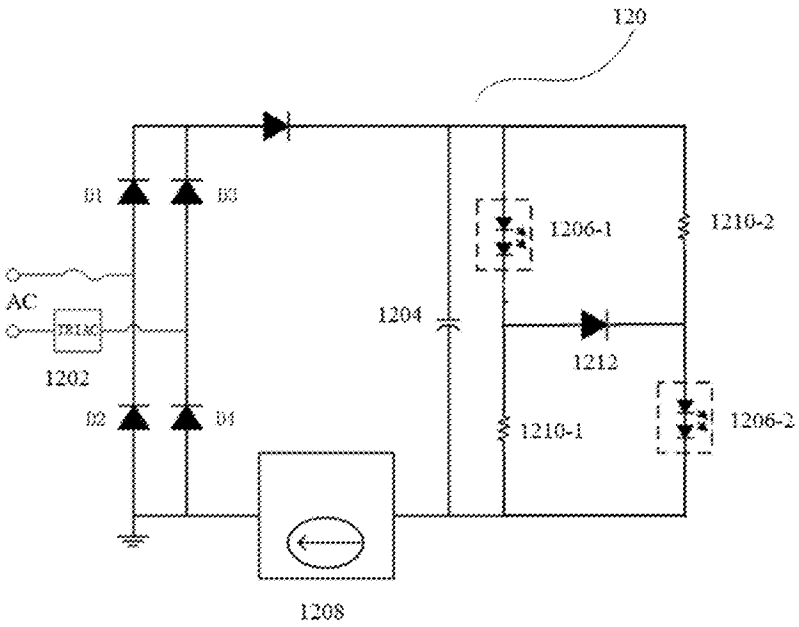
FIG. 12 shows a circuit diagram of an illumination device according to another embodiment of the present utility model.

FIG. 12 shows a circuit diagram of an illumination device according to another embodiment of the present utility model. In the circuit configuration shown in FIG. 12, the main difference from FIG. 9 is that the color temperatures of the first illumination unit 1206-1 and the second illumination unit 1206-2 are different from each other. In other respects, the illumination device shown in FIG. 12 is similar to the device shown in FIG. 9. For example, the first illumination unit 1206-1, the second illumination unit 1206-2, the first current-limiting unit 1210-1, the second current-limiting unit 1210-2, and the unidirectional conduction unit 1212 in the illumination device 120 are all contained in a filament. For example, the filament includes a substrate, and the first illumination unit 1206-1, the second illumination unit 1206-2, the first current-limiting unit 1210-1, the second current-limiting unit 1210-2, and the unidirectional conduction unit 1212 are arranged on the substrate. According to actual needs, the arrangement modes of the first illumination unit 1206-1, the second illumination unit 1206-2, the first current-limiting unit 1210-1, the second current-limiting unit 1210-2, and the unidirectional conduction unit 1212 may be arbitrarily selected. For example, the first illumination unit 1206-1 and the second illumination unit 1206-2 may be arranged side by side on the substrate, or the first illumination unit 1206-1 and the second illumination unit 1206-2 may be arranged in a row on the substrate. Next, referring to FIG. 12, the operation mode of the illumination device 120 is described in detail.

In the illumination device for achieving warm dimming, the color temperatures of the first illumination unit 1206-1 and the second illumination unit 1206-2 are different from each other. It is assumed that the color temperature of the first illumination unit 1206-1 is less than the color temperature of the second illumination unit 1206-2, and the turn-on voltage of the first illumination unit 1206-1 is less than the turn-on voltage of the second illumination unit 1206-2, the resistance value of the first current-limiting 1210-1 is less than or equal to the resistance value of the second current-limiting unit 1210-2. For example, according to the operation of a user on a dimming controller, a phase-cut angle of the dimming unit 1202 is varied, and the amplitude of the input voltage from an external power source AC is varied with the change of the phase-cut angle, and then through a rectifier bridge, the input voltage of which the amplitude is varied on the basis of the phase-cut angle is applied to two ends of a capacitor 1204, and the voltage at the two ends of the capacitor 1204 is applied to the first illumination unit 1206-1 and the second illumination unit 1206-2. While the amplitude of the input voltage varied on the basis of the phase-cut angle is greater than or equal to a sum of a turn-on voltage of the first illumination unit 1206-1 and a turn-on voltage of the second illumination unit 1206-2, namely, in the case that the amplitude of the input voltage is relatively large, the unidirectional conduction unit 1212 is turned on, and the first illumination unit 1206-1, the unidirectional conduction unit 1212, and the second illumination unit 1206-2 form a series connection. At this time, the current flowing through the first current-limiting unit 1210-1 and the second current-limiting unit 1210-2 is relatively small, and the illumination device 120 operates in the first operation mode. In this case, the color temperature of the illumination device 120 is: the average value of the color temperatures of the first illumination unit 1206-1 and the second illumination unit 1206-2. In the process of dimming, while the amplitude of the input voltage varied on the basis of the phase-cut angle becomes less than the sum of the turn-on voltage of the first illumination unit 1206-1 and the turn-on voltage of the second illumination unit 1206-2, and the amplitude of the input voltage varied on the basis of the phase-cut angle is greater than the turn-on voltage of the second illumination unit 1206-2, namely, in the case that the amplitude of the input voltage is relatively small, the unidirectional conduction unit 1212 is in the turn-off state, the first illumination unit 1206-1 and the first current-limiting unit 1210-1 form a first series circuit, the second illumination unit 1206-2 and the second current-limiting unit 1210-2 form a second series circuit, the first series circuit and the second series circuit are connected in parallel, and the illumination device 120 operates in the second operation mode. In this case, the color temperature of the illumination device 120 is: the average value of the color temperatures of the first illumination unit 1206-1 and the second illumination unit 1206-2. Next, if the amplitude of the input voltage varied on the basis of the phase-cut angle continues to decrease below the turn-on voltage of the second illumination unit 1206-2, the first series circuit formed by the first illumination unit 1206-1 and the first current-limiting unit 1210-1 is in the turn-on state, the second series circuit formed by the second illumination unit 1206-2 and the second current-limiting unit 1210-2 is in the turn-off state, and the illumination device 120 operates in the third operation mode. At this time, only the first illumination unit 1206-1 emits light, the second illumination unit 1206-2 is turned off, and the color temperature of the illumination device 120 is equal to the color temperature of the first illumination unit 1206-1. Therefore, in the illumination device provided by the present utility model, according to the amplitude of the input voltage, the connection modes of the first illumination unit 1206-1 and the second illumination unit 1206-2 with the different color temperatures are automatically switched, thereby not only the dimming stroke may be prolonged, but also the dimming depth is deepened, and the warm dimming may be achieved.

In the illumination device for achieving the warm dimming, the color temperatures of the first illumination unit 1206-1 and the second illumination unit 1206-2 are different from each other, and the color temperature and/or brightness of the illumination device 120 operated in the first operation mode is higher than the color temperature and/or brightness of the illumination device 120 operated in the second operation mode, and the color temperature and/or brightness of the illumination device 120 operated in the second operation mode is higher than the color temperature and/or brightness of the illumination device 120 operated in the third operation mode.

Figure 10:
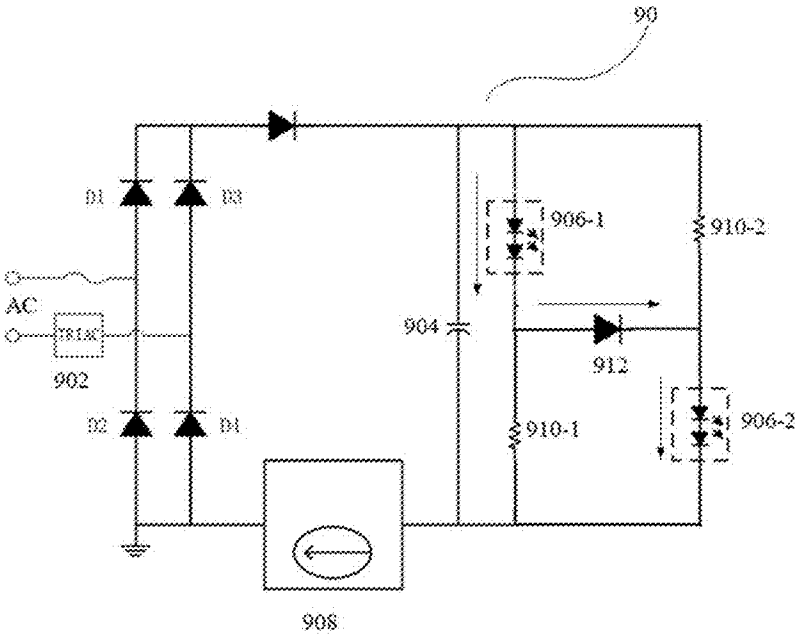
FIG. 10 shows a circuit diagram of the illumination device shown in FIG. 9 operated in a first operation mode.
Figure 11:
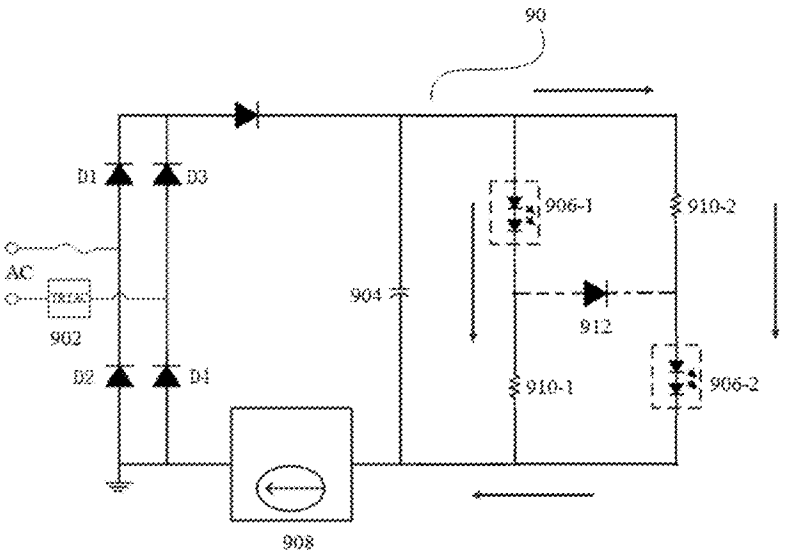
FIG. 11 shows a circuit diagram of the illumination device shown in FIG. 9 operated in a second operation mode.
Figure 13:
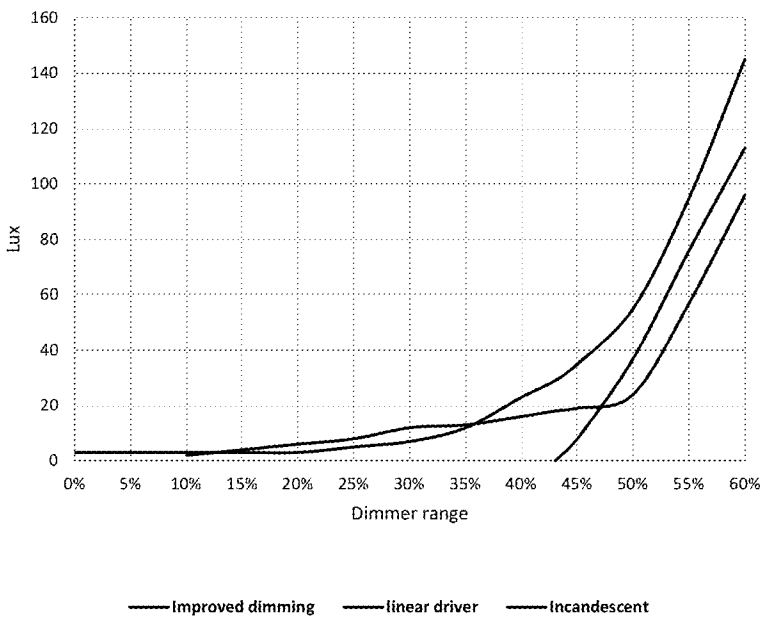
FIG. 13 shows a curve diagram of a relationship between the illuminance and the dimming range of the illumination device in an existing technology and the illumination device shown in FIG. 9 or FIG. 10.
Figure 13:
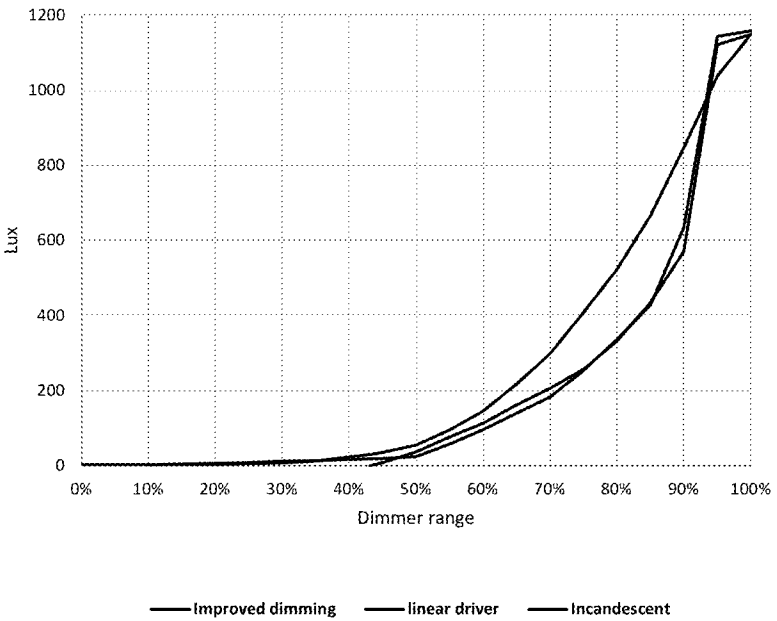

FIG. 13 shows a curve diagram of a relationship between the illuminance and the dimming range of the illumination device in an existing technology and the illumination device shown in FIG. 9 or FIG. 10. The curve diagram of the relationship between the illuminance and the dimming range of the illumination device in the existing technology is shown in (A) of FIG. 13, and the curve diagram of the relationship between the illuminance and the dimming range of the illumination device shown in FIG. 9 or FIG. 10 according to the present utility model is shown in (B) of FIG. 13. As shown in FIG. 13, compared with the performance of the illumination device in the existing technology, the dimming depth and the dimming stroke achieved by the illumination device according to the present utility model are significantly improved.

The present utility model is implemented in a most preferred manner to solve the problem in the prior art that the illumination device is not compatible with different input methods.

From the description above, it can be seen that the embodiments of the present utility model achieve the following technical effects:

1. prolonging a dimming stroke of the illumination device;
2. deepening the dimming depth; and
3. achieving deeper warm dimming.

It is obvious that the illustrated embodiments are only some parts of the embodiments of the present utility model and are not all of the embodiments of the present utility model. All embodiments obtained by an ordinary person skilled in the art without involving inventive work based on the embodiments of the present utility model fall into the scope of protection of the present utility model.

It should be noted that the terminology used herein is for the purpose of describing particular embodiments only and is not intended to be limiting of exemplary embodiments in accordance with the present application. As used herein, the singular form is intended to include the plural form, unless otherwise noted in the context, and further it should be understood that the terms "comprises" and/or "includes" when used in this description, specify the presence of features, steps, operations, devices, components, and/or combinations thereof.

It should be noted that, terms such as "first" and "second" in the description, claims and accompanying drawings of the present application are used to distinguish similar objects, but are not necessarily used to describe a specific sequence or order. It should be understood that the data used in such way may be intervaried where appropriate, so that the embodiments of the present application described herein can be implemented in sequences other than those illustrated or described herein.

The preferred embodiments of the present utility model described above are intended to illustrate but not limit the present utility model. To those skilled in the art, various modifications and variations may be available for the present utility model. Any modification, equivalent substitution, and improvement within the spirit and principle of the present utility model should be covered in the scope of protection of the present utility model.

What is claimed is:

1. An illumination device comprising:

a dimming unit electrically connected to an external power supply;

a first illumination unit which is electrically connected to the dimming unit and to which an input voltage from the external power supply is applied;

a second illumination unit which is electrically connected to the dimming unit and to which an input voltage from the external power supply is applied;

a unidirectional conduction unit electrically connected to the first illumination unit and the second illumination unit;

a first current-limiting unit electrically connected to the first illumination unit; and a second current-limiting unit electrically connected to the second illumination unit, wherein the amplitude of the input voltage varies on the basis of a phase-cut angle of the dimming unit, when the amplitude of the input voltage varied on the basis of the phase-cut angle satisfies a first predetermined condition, the unidirectional conduction unit is in a turn-on state, and the illumination device operated in a first operation mode; and when the amplitude of the input voltage varied on the basis of the phase-cut angle satisfies a second predetermined condition, the unidirectional conduction unit is in a turn-off state, and the illumination device operates in a second operation mode.

2. The illumination device according to claim 1, wherein the first predetermined condition is that the amplitude of the input voltage varied on the basis of the phase-cut angle is greater than or equal to a sum of a turn-on voltage of the first illumination unit and a turn-on voltage of the second illumination unit.

3. The illumination device according to claim 1, wherein in the first operation mode, the first illumination unit, the unidirectional conduction unit and the second illumination unit are connected in series.

4. The illumination device according to claim 1, wherein the second predetermined condition is that the amplitude of the input voltage varied on the basis of the phase-cut angle is less than the sum of the turn-on voltage of the first illumination unit and the turn-on voltage of the second illumination unit.

5. The illumination device according to claim 1, wherein in the second operation mode, the first illumination unit and the first current-limiting unit form a first series circuit, the second illumination unit and the second current-limiting unit form a second series circuit, and the first series circuit and the second series circuit are connected in parallel.

6. The illumination device according to claim 1, wherein when the amplitude of the input voltage varied on the basis of the phase-cut angle satisfies a third predetermined condition, the unidirectional conduction unit is in a turn-off state, and the illumination device operates in a third operation mode.

7. The illumination device according to claim 6, wherein the third predetermined condition is that the amplitude of the input voltage varied on the basis of the phase-cut angle is greater than the turn-on voltage of the first illumination unit and less than the turn-on voltage of the second illumination unit.

8. The illumination device according to claim 6, wherein in the third operation mode, the first illumination unit is in a turn-on state and the second illumination unit is in a turn-off state.

9. The illumination device according to claim 1, wherein in cases where the color temperature of the first illumination unit is the same as the color temperature of the second illumination unit, the brightness of the illumination device operated in the first operation mode is higher than the brightness of the illumination device operated in the second operation mode;

in cases where the color temperature of the first illumination unit is different from the color temperature of the second illumination unit, the color temperature of the illumination device operated in the first operation mode is higher than the color temperature of the illumination device operated in the second operation mode, and/or the brightness of the illumination device operated in the first operation mode is higher than the brightness of the illumination device operated in the second operation mode.

10. The illumination device according to claim 6, wherein in cases where the color temperature of the first illumination unit is the same as the color temperature of the second illumination unit, the brightness of the illumination device operated in the first operation mode is higher than the brightness of the illumination device operated in the second operation mode, and the brightness of the illumination device operated in the second operation mode is higher than the brightness of the illumination device operated in the third operation mode; and in cases where the color temperature of the first illumination unit is different from the color temperature of the second illumination unit, the color temperature and/or brightness of the illumination device operated in the first operation mode is higher than the color temperature and/or brightness of the illumination device operated in the second operation mode, the color temperature and/or the brightness of the illumination device operated in the second operation mode is higher than the color temperature and/or the brightness of the illumination device operated in the third operation mode.

11. The illumination device according to claim 1, wherein a positive terminal of the unidirectional conduction unit is connected to a common terminal of the first illumination unit and the first current-limiting unit, and a negative terminal of the unidirectional conduction unit is connected to a common terminal of the second illumination unit and the second current-limiting unit.

12. The illumination device according to claim 1, wherein the illumination device further comprises an illumination unit driver electrically connected to the dimming unit, the first illumination unit, and the second illumination unit.

13. The illumination device according to claim 1, wherein each of the first illumination unit and the second illumination unit comprises one or more light-emitting devices (LED) connected in series or in parallel.

14. The illumination device according to claim 1, wherein each of the first current-limiting unit and the second current-limiting unit comprises a resistor.

15. The illumination device according to claim 1, wherein the unidirectional conduction unit comprises at least one of a transistor, a thyristor, and a relay.

16. The illumination device according to claim 15, wherein the transistor comprises a light emitting diode.

17. A filament device for the illumination device of claim 1, wherein the filament device comprising:

a substrate wherein the first illumination unit is arranged on the substrate and the second illumination unit is arranged on the substrate.

18. A dimming method for an illumination device, the illumination device comprising: a dimming unit electrically connected to an external power supply; a first illumination unit which is electrically connected to the dimming unit and to which an input voltage from the external power supply is applied; a second illumination unit which is electrically connected to the dimming unit and to which an input voltage from the external power supply is applied; a unidirectional conduction unit electrically connected to the first illumination unit and the second illumination unit; a first current-limiting unit electrically connected to the first illumination unit; and a second current-limiting unit electrically connected to the second illumination unit, the method comprising:

varying an amplitude of the input voltage on the basis of a phase-cut angle of the dimming unit;

wherein when the amplitude of the input voltage varied on the basis of the phase-cut angle satisfies a first predetermined condition, the unidirectional conduction unit is in a turn-on state, and the illumination device operated in a first operation mode; and when the amplitude of the input voltage varied on the basis of the phase-cut angle satisfies a second predetermined condition, the unidirectional conduction unit is in a turn-off state, and the illumination device operates in a second operation mode.

19. The dimming method for the illumination device according to claim 18, wherein the first predetermined condition is that the amplitude of the input voltage varied on the basis of the phase-cut angle is greater than or equal to a sum of a turn-on voltage of the first illumination unit and a turn-on voltage of the second illumination unit.

20. The dimming method for the illumination device according to claim 18, wherein in the first operation mode, the first illumination unit, the unidirectional conduction unit and the second illumination unit are connected in series.

21. The dimming method for the illumination device according to claim 18, wherein the second predetermined condition is that the amplitude of the input voltage varied on the basis of the phase-cut angle is less than the sum of the turn-on voltage of the first illumination unit and the turn-on voltage of the second illumination unit.

22. The dimming method for the illumination device according to claim 18, wherein in the second operation mode, the first illumination unit and the first current-limiting unit form a first series circuit, the second illumination unit and the second current-limiting unit form a second series circuit, and the first series circuit and the second series circuit are connected in parallel.

23. The dimming method for the illumination device according to claim 18, wherein when the amplitude of the input voltage varied on the basis of the phase-cut angle satisfies a third predetermined condition, the unidirectional conduction unit is in a turn-off state, and the illumination device operates in a third operation mode.

24. The dimming method for the illumination device according to claim 23, wherein the third predetermined condition is that the amplitude of the input voltage varied on the basis of the phase-cut angle is greater than the turn-on voltage of the first illumination unit and less than the turn-on voltage of the second illumination unit.

25. The dimming method for the illumination device according to claim 23, wherein in the third operation mode, the first illumination unit is in a turn-on state and the second illumination unit is in a turn-off state.

26. The dimming method for the illumination device according to claim 18, wherein in cases where the color temperature of the first illumination unit is the same as the color temperature of the second illumination unit, the brightness of the illumination device operated in the first operation mode is higher than the brightness of the illumination device operated in the second operation mode;

in cases where the color temperature of the first illumination unit is different from the color temperature of the second illumination unit, the color temperature of the illumination device operated in the first operation mode is higher than the color temperature of the illumination device operated in the second operation mode, and/or the brightness of the illumination device operated in the first operation mode is higher than the brightness of the illumination device operated in the second operation mode.

27. The dimming method for the illumination device according to claim 23, wherein in cases where the color temperature of the first illumination unit is the same as the color temperature of the second illumination unit, the brightness of the illumination device operated in the first operation mode is higher than the brightness of the illumination device operated in the second operation mode, the brightness of the illumination device operated in the second operation mode is higher than the brightness of the illumination device operated in the third operation mode; and in cases where the color temperature of the first illumination unit is different from the color temperature of the second illumination unit, the color temperature and/or brightness of the illumination device operated in the first operation mode is higher than the color temperature and/or brightness of the illumination device operated in the second operation mode, the color temperature and/or the brightness of the illumination device operated in the second operation mode is higher than the color temperature and/or the brightness of the illumination device operated in the third operation mode.

* * * * *